US009791209B2

(12) United States Patent
Gandhi et al.

(10) Patent No.: US 9,791,209 B2
(45) Date of Patent: Oct. 17, 2017

(54) SYSTEM AND PROCESS FOR LIQUEFYING NATURAL GAS

(71) Applicant: CONOCOPHILLIPS COMPANY, Houston, TX (US)

(72) Inventors: Satish L. Gandhi, Houston, TX (US); Jim L. Rockwell, Houston, TX (US); Karl L. Herzog, Houston, TX (US); David C. Vogel, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 295 days.

(21) Appl. No.: 14/681,255

(22) Filed: Apr. 8, 2015

(65) Prior Publication Data

US 2015/0300732 A1 Oct. 22, 2015

Related U.S. Application Data

(60) Provisional application No. 61/980,195, filed on Apr. 16, 2014.

(51) Int. Cl.
*F25J 1/00* (2006.01)
*F25J 1/02* (2006.01)

(52) U.S. Cl.
CPC ..... *F25J 1/0022* (2013.01); *F25J 1/004* (2013.01); *F25J 1/0052* (2013.01); *F25J 1/0082* (2013.01);
(Continued)

(58) Field of Classification Search
CPC ..... F25J 1/0022; F25J 1/0085; F25J 1/0264; F25J 1/0211–1/0219; F25J 1/0055; F25J 1/0052; F25J 1/0208; F25J 1/0209; F25J 1/021; F25J 2245/02; F25J 2220/62; F25J 2200/64; F25J 2210/04; F25J 2210/06; F25J 1/004; F25J 3/0257; F25J 3/0233; F25J 1/0082; F25J 1/0087
See application file for complete search history.

(56) References Cited

U.S. PATENT DOCUMENTS 6,640,586 B1 11/2003 Baudat et al.
2006/0137391 A1 6/2006 Baudat et al.
(Continued)

OTHER PUBLICATIONS

International Search Report. PCT/US2015/024942 Dated July 6, 2015.

*Primary Examiner* — Keith Raymond
(74) *Attorney, Agent, or Firm* — ConocoPhillips Company

(57) ABSTRACT

A process of liquefying a natural gas stream in a liquefied natural gas facility is provided. The process includes cooling the natural gas stream in a first refrigeration cycle to produce a cooled natural gas stream. The process also includes cooling the cooled natural gas stream in a first chiller of a second refrigeration cycle, the cooled natural gas stream exiting the first chiller at a first pressure. The process further includes cooling the cooled natural gas stream in a first core of a second chiller of the second refrigeration cycle. The process yet further includes cooling a refrigerant of a refrigerant recycle stream separate from the cooled natural gas stream in a second core of the second chiller of the second refrigeration cycle, wherein the refrigerant recycle stream enters the second chiller at a second pressure that is lower than the first pressure of the cooled natural gas stream.

10 Claims, 1 Drawing Sheet

(52) U.S. Cl.
CPC ..... *F25J 1/0085* (2013.01); *F25J 1/0087* (2013.01); *F25J 1/021* (2013.01); *F25J 1/023* (2013.01); *F25J 1/0208* (2013.01); *F25J 1/0209* (2013.01); *F25J 1/0219* (2013.01); *F25J 1/0264* (2013.01); *F25J 1/0265* (2013.01); *F25J 2210/04* (2013.01); *F25J 2210/06* (2013.01); *F25J 2220/62* (2013.01); *F25J 2220/64* (2013.01); *F25J 2245/02* (2013.01); *F25J 2290/34* (2013.01)

(56) References Cited

U.S. PATENT DOCUMENTS

| | | | | |
|---|---|---|---|---|
| 2008/0098770 | A1 | 5/2008 | Ransbarger | |
| 2009/0151391 | A1 | 6/2009 | Huang et al. | |
| 2009/0277217 | A1* | 11/2009 | Ransbarger ..... | F25J 1/0022 62/612 |
| 2010/0058803 | A1* | 3/2010 | Ransbarger ..... | F25J 1/0022 62/612 |
| 2012/0204598 | A1 | 8/2012 | Mock et al. | |

* cited by examiner

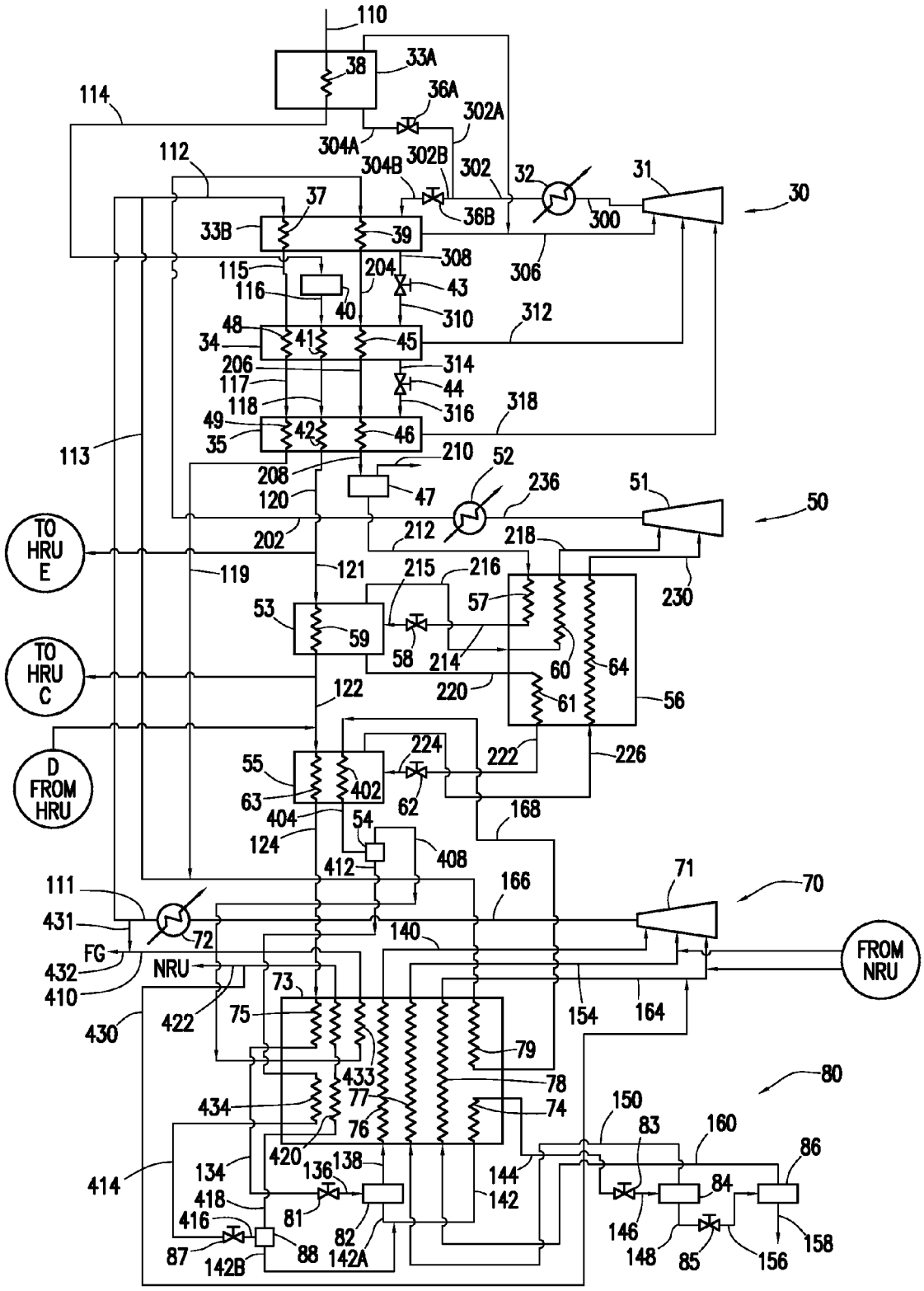
TO HRU E
TO HRU C
D FROM HRU
FROM NRU
FG
NRU

SYSTEM AND PROCESS FOR LIQUEFYING NATURAL GAS

CROSS REFERENCE TO RELATED APPLICATIONS

This application claims benefit of U.S. Patent Application Ser. No. 61/980,195 filed Apr. 16, 2014, entitled "SYSTEM AND PROCESS FOR LIQUEFYING NATURAL GAS," which is hereby incorporated by reference.

FIELD OF THE INVENTION

This invention relates to systems and processes for liquefying natural gas and, more particularly, to improving system efficiency by independently managing a natural gas feed stream and a refrigerant.

BACKGROUND OF THE INVENTION

Cryogenic liquefaction is commonly used to convert natural gas into a more convenient form for transportation and/or storage. Because liquefying natural gas greatly reduces its specific volume, large quantities of natural gas can be economically transported and/or stored in liquefied form.

Transporting natural gas in its liquefied form can effectively link a natural gas source with a distant market when the source and market are not connected by a pipeline. This situation commonly arises when the source of natural gas and the market for the natural gas are separated by large bodies of water. In such cases, liquefied natural gas (LNG) can be transported from the source to the market using specially designed ocean-going LNG tankers.

Storing natural gas in its liquefied form can help balance periodic fluctuations in natural gas supply and demand. In particular, LNG can be "stockpiled" for use when natural gas demand is low and/or supply is high. As a result, future demand peaks can be met with LNG from storage, which can be vaporized as demand requires.

Several methods exist for liquefying natural gas. Some methods produce a pressurized LNG (PLNG) product that is useful, but requires expensive pressure-containing vessels for storage and transportation. Other methods produce an LNG product having a pressure at or near atmospheric pressure. In general, these non-pressurized LNG production methods involve cooling a high pressure natural gas stream through indirect heat exchange with one or more refrigerants and then expanding the cooled natural gas stream to near atmospheric pressure. In addition, some LNG facilities employ one or more systems to remove contaminants (e.g., water, mercury and mercury components, acid gases, and nitrogen, as well as a portion of ethane and heavier components) from the natural gas stream at different points during the liquefaction process.

In certain LNG facilities, an inlet gas stream is combined with one or more lower pressure refrigerants into a single combined stream that is then further cooled and processed. The combined stream is then fed to a nitrogen rejection unit (NRU), used as fuel gas, and/or processed further. In the case of methane as the refrigerant, the higher concentration of nitrogen in the methane stream is diluted upon combination with the inlet gas stream. Dilution requires a larger volume of the combined stream to be sent through the NRU for processing to an acceptable amount of nitrogen. The combined stream feed volume required to be sent to the NRU impacts the equipment size and cost of the NRU.

SUMMARY OF THE INVENTION

In one embodiment of the invention, a process of liquefying a natural gas stream in a liquefied natural gas (LNG) facility is provided. The process includes cooling the natural gas stream in a first refrigeration cycle to produce a cooled natural gas stream. The process also includes cooling the cooled natural gas stream in a first chiller of a second refrigeration cycle, the cooled natural gas stream exiting the first chiller at a first pressure. The process further includes cooling the cooled natural gas stream in a first core of a second chiller of the second refrigeration cycle. The process yet further includes cooling a refrigerant of a refrigerant recycle stream separate from the cooled natural gas stream in a second core of the second chiller of the second refrigeration cycle, wherein the refrigerant recycle stream enters the second chiller at a second pressure that is lower than the first pressure of the cooled natural gas stream.

In another embodiment of the invention, a system for liquefying natural gas includes a first refrigeration cycle including a plurality of chillers configured to cool a natural gas feed stream. Also included is a second refrigeration cycle including a first chiller and a second chiller each configured to cool the natural gas feed stream. Further included is a refrigerant of a refrigerant recycle stream. Yet further included is a first core of the second chiller configured to route the natural gas feed stream through the second chiller. Also included is a second core of the second chiller configured to route the refrigerant recycle stream through the second chiller, wherein the natural gas feed stream and the refrigerant recycle stream are separately cooled and condensed in the second chiller.

BRIEF DESCRIPTION OF THE DRAWINGS

The invention, together with further advantages thereof, may best be understood by reference to the following description taken in conjunction with the accompanying FIGURES by way of example and not by way of limitation, in which:

FIG. 1 is a schematic of a cascade-type LNG facility configured in accordance with one embodiment of the invention.

DETAILED DESCRIPTION OF THE INVENTION

Reference will now be made in detail to embodiments of the invention, one or more examples of which are illustrated in the accompanying drawings. Each example is provided by way of explanation of the invention, not as a limitation of the invention. It will be apparent to those skilled in the art that various modifications and variation can be made in the present invention without departing from the scope or spirit of the invention. For instance, features illustrated or described as part of one embodiment can be used on another embodiment to yield a still further embodiment. Thus, it is intended that the present invention cover such modifications and variations that come within the scope of the appended claims and their equivalents.

The present invention can be implemented in a facility used to cool natural gas to its liquefaction temperature to thereby produce liquefied natural gas (LNG). The LNG facility generally employs one or more refrigerants to extract heat from the natural gas and reject to the environment. Numerous configurations of cascade LNG systems exist and the present invention may be implemented in many different types of cascade LNG systems.

In one embodiment, the present invention is implemented in a cascade LNG system employing a cascade-type refrigeration process using one or more predominately pure component refrigerants. The refrigerants utilized in cascade-type refrigeration processes can have successively lower boiling points in order to facilitate heat removal from the natural gas stream being liquefied. Additionally, cascade-type refrigeration processes can include some level of heat integration. For example, a cascade-type refrigeration process can cool one or more refrigerants having a higher volatility through indirect heat exchange with one or more refrigerants having a lower volatility. In addition to cooling the natural gas stream through indirect heat exchange with one or more refrigerants, cascade LNG system can employ one or more expansion cooling stages to simultaneously cool the LNG while reducing its pressure.

The embodiments illustrated and described below refer to systems and processes that include a heavies removal unit or zone. However, it is to be appreciated that there are many instances where a heavies removal unit or zone is not present.

Referring now to FIG. 1, one embodiment of a cascade-type LNG facility in accordance with one embodiment of the present invention is illustrated. The LNG facility depicted in FIG. 1 generally comprises a propane refrigeration cycle 30, an ethylene refrigeration cycle 50, and a methane refrigeration cycle 70 with an expansion section 80. While "propane," "ethylene," and "methane" are used to refer to respective first, second, and third refrigerants, it should be understood that the embodiment illustrated in FIG. 1 and described herein can apply to any combination of suitable refrigerants. The main components of propane refrigeration cycle 30 include a propane compressor 31, a propane cooler/condenser 32, high-stage propane chillers 33A and 33B, an intermediate-stage propane chiller 34, and a low-stage propane chiller 35. The main components of ethylene refrigeration cycle 50 include an ethylene compressor 51, an ethylene cooler 52, a high-stage ethylene chiller 53, a low-stage ethylene chiller/condenser 55, and an ethylene economizer 56. The main components of methane refrigeration cycle 70 include a methane compressor 71, a methane cooler 72, and a methane economizer 73. The main components of expansion section 80 include a first high-stage methane expansion valve and/or expander 81, a first high-stage methane flash drum 82, a second high-stage methane expansion valve and/or expander 87, a second high-stage methane flash drum 88, an intermediate-stage methane expansion valve and/or expander 83, an intermediate-stage methane flash drum 84, a low-stage methane expansion valve and/or expander 85, and a low-stage methane flash drum 86.

The operation of the LNG facility illustrated in FIG. 1 will now be described in more detail, beginning with propane refrigeration cycle 30. Propane is compressed in multi-stage (e.g., three-stage) propane compressor 31 driven by, for example, a gas turbine driver (not illustrated). The stages of compression may exist in a single unit or two or more separate units mechanically coupled to a single driver. Upon compression, the propane is passed through conduit 300 to propane cooler 32, wherein it is cooled and condensed through indirect heat exchange with an external fluid (e.g., air or water). The stream from propane cooler 32 can then be passed through conduits 302A and 302B to pressure reduction means, illustrated as expansion valves 36A and 36B, wherein the pressure of the liquefied propane is reduced, thereby evaporating or flashing a portion thereof. The resulting two-phase streams then flow through conduits 304A and 304B into high-stage propane chillers 33A and 33B. High stage propane chiller 33A uses the flashed propane refrigerant to cool the incoming natural gas stream in conduit 110. High stage propane chiller 33B uses the flashed propane refrigerant to cool the predominantly methane refrigerant stream in conduit 112.

The cooled natural gas stream from high-stage propane chiller 33A flows through conduit 114 to a separation vessel, wherein water and in some cases propane and heavier components are removed, typically followed by a treatment system 40, in cases where not already completed in upstream processing, wherein moisture, mercury and mercury compounds, particulates, and other contaminants are removed to create a treated stream. The stream exits the treatment system 40 through conduit 116. The stream can then enter intermediate-stage propane chiller 34, wherein the stream is cooled in indirect heat exchange means 41 through indirect heat exchange with a yet-to-be-discussed propane refrigerant stream. The resulting cooled stream in conduit 118 is then routed to low-stage propane chiller 35, wherein the stream can be further cooled through indirect heat exchange means 42. The resultant cooled stream can then exit low-stage propane chiller 35 through conduit 120. Subsequently, the cooled stream in conduit 120 can be routed to high-stage ethylene chiller 53, which will be discussed in more detail shortly.

The combined vaporized propane refrigerant stream exiting high-stage propane chillers 33A and 33B is returned to the high-stage inlet port of propane compressor 31 through conduit 306. The liquid propane refrigerant in high-stage propane chiller 33A provides refrigeration duty for the natural gas stream 110. The liquefied portion of the propane refrigerant exits high-stage propane chiller 33B through conduit 308 and is passed through a pressure-reduction means, illustrated here as expansion valve 43, whereupon the pressure of the liquefied propane refrigerant is reduced to thereby flash or vaporize a portion thereof. The resulting two-phase refrigerant stream can enter the intermediate-stage propane chiller 34 through conduit 310, thereby providing coolant for the natural gas stream (in conduit 116) and to yet-to-be-discussed streams entering intermediate-stage propane chiller 34 through conduits 115 and 204. The vaporized portion of the propane refrigerant exits intermediate-stage propane chiller 34 through conduit 312 and can then enter the intermediate-stage inlet port of propane compressor 31. The liquefied portion of the propane refrigerant exits intermediate-stage propane chiller 34 through conduit 314 and is passed through a pressure-reduction means, illustrated here as expansion valve 44, whereupon the pressure of the liquefied propane refrigerant is reduced to thereby flash or vaporize a portion thereof. The resulting vapor-liquid refrigerant stream can then be routed to low-stage propane chiller 35 through conduit 316 and where the refrigerant stream can cool the natural gas stream (in conduit 118) and yet-to-be-discussed streams entering low-stage propane chiller 35 through conduits 117 and 206, respectively. The vaporized propane refrigerant stream then exits low-stage propane chiller 35 and is routed to the low-stage inlet port of propane compressor 31 through conduit 318 wherein it is compressed and recycled as previously described.

As shown in FIG. 1, a stream of ethylene refrigerant in conduit 202 enters high-stage propane chiller 33B, wherein the ethylene stream is cooled through indirect heat exchange means 39. The resulting cooled ethylene stream can then be routed in conduit 204 from high-stage propane chiller 33B to intermediate-stage propane chiller 34. Upon entering intermediate-stage propane chiller 34, the ethylene refrigerant stream can be further cooled through indirect heat exchange means 45 in intermediate-stage propane chiller 34. The resulting cooled ethylene stream can then exit intermediate-stage propane chiller 34 and can be routed through conduit 206 to enter low-stage propane chiller 35. In low-stage propane chiller 35, the ethylene refrigerant stream can be at least partially condensed, or condensed in its entirety, through indirect heat exchange means 46. The resulting stream exits low-stage propane chiller 35 through conduit 208 and can subsequently be routed to a separation vessel 47, wherein a vapor portion of the stream, if present, can be removed through conduit 210, while a liquid portion of the ethylene refrigerant stream can exit separator 47 through conduit 212. The liquid portion of the ethylene refrigerant stream exiting separator 47 can have a representative temperature and pressure of about −24° F. (about −31° C.) and about 285 psia (about 1,965 kPa).

Turning now to ethylene refrigeration cycle 50 in FIG. 1, the liquefied ethylene refrigerant stream in conduit 212 can enter ethylene economizer 56, wherein the stream can be further cooled by an indirect heat exchange means 57. The resulting cooled liquid ethylene stream in conduit 214 can then be routed through a pressure reduction means, illustrated here as expansion valve 58, whereupon the pressure of the cooled predominantly liquid ethylene stream is reduced to thereby flash or vaporize a portion thereof. The cooled, two-phase stream in conduit 215 can then enter high-stage ethylene chiller 53. In high-stage ethylene chiller 53, at least a portion of the ethylene refrigerant stream can vaporize to further cool the stream in conduit 121 by an indirect heat exchange means 59. The vaporized and remaining liquefied ethylene refrigerant exits high-stage ethylene chiller 53 through respective conduits 216 and 220. The vaporized ethylene refrigerant in conduit 216 can re-enter ethylene economizer 56, wherein the stream can be warmed through an indirect heat exchange means 60 prior to entering the high-stage inlet port of ethylene compressor 51 through conduit 218, as shown in FIG. 1. The cooled stream in conduit 120 exiting low-stage propane chiller 35 can thereafter be split into two portions.

At least a portion of the natural gas stream can be routed through conduit E to a heavies removal unit (HRU). The remaining portion of the cooled natural gas stream in conduit 121 can be routed to high-stage ethylene chiller 53, and then can be cooled in indirect heat exchange means 59 of high-stage ethylene chiller 53.

The remaining liquefied ethylene refrigerant exiting high-stage ethylene chiller 53 in conduit 220 can re-enter ethylene economizer 56, to be further sub-cooled by an indirect heat exchange means 61. The resulting sub-cooled refrigerant stream exits ethylene economizer 56 through conduit 222 and can subsequently be routed to a pressure reduction means, illustrated here as expansion valve 62, whereupon the pressure of the refrigerant stream is reduced to thereby vaporize or flash a portion thereof. The resulting, cooled two-phase stream in conduit 224 enters low-stage ethylene chiller/condenser 55.

A portion of the cooled natural gas stream exiting high-stage ethylene chiller 53 can be routed through conduit C to the heavies removal unit, while another portion of the cooled natural gas stream exiting high-stage ethylene chiller/condenser 53 combined with the vapor stream exiting the heavies removal unit in conduit D (i.e., HRU return stream) can be routed through conduit 122 to enter indirect heat exchange means 63 of low-stage ethylene chiller/condenser 55.

In low-stage ethylene chiller/condenser 55, the cooled natural gas stream can be at least partially condensed through indirect heat exchange with the ethylene refrigerant entering low-stage ethylene chiller/condenser 55 through conduit 224. The vaporized ethylene refrigerant exits low-stage ethylene chiller/condenser 55 through conduit 226 and then enters ethylene economizer 56. In ethylene economizer 56, the vaporized ethylene refrigerant stream can be warmed through an indirect heat exchange means 64 prior to being fed into the low-stage inlet port of ethylene compressor 51 through conduit 230. As shown in FIG. 1, a stream of compressed ethylene refrigerant exits ethylene compressor 51 through conduit 236 and can subsequently be routed to ethylene cooler 52, wherein the compressed ethylene stream can be cooled through indirect heat exchange with an external fluid (e.g., water or air). The resulting cooled ethylene stream can then be introduced through conduit 202 into high-stage propane chiller 33B for additional cooling as previously described.

The cooled natural gas stream exiting low-stage ethylene chiller/condenser 55 in conduit 124 can also be referred to as the "pressurized LNG-bearing stream." As shown in FIG. 1, the pressurized LNG-bearing stream exits low-stage ethylene chiller/condenser 55 through conduit 124 prior to entering methane economizer 73. In methane economizer 73, the pressurized LNG-bearing stream in conduit 124 can be cooled in an indirect heat exchange means 75 through indirect heat exchange with one or more yet-to-be discussed methane refrigerant streams. The cooled, pressurized LNG-bearing stream exits the methane economizer 73 through conduit 134 and can then be routed into expansion section 80 of methane refrigeration cycle 70. In expansion section 80, the pressurized LNG-bearing stream first passes through first high-stage methane expansion valve 81 and/or expander, whereupon the pressure of this stream is reduced to thereby vaporize or flash a portion thereof. The resulting two-phase methane-rich stream in conduit 136 can then enter high-stage methane flash drum 82, whereupon the vapor and liquid portions of the reduced-pressure stream can be separated. The vapor portion of the reduced-pressure stream (also called the high-stage flash gas) exits high-stage methane flash drum 82 through conduit 138 to then enter methane economizer 73, wherein the high-stage flash gas can be heated through indirect heat exchange means 76 of methane economizer 73. The resulting warmed vapor stream exits main methane economizer 73 through conduit 140 and can then be routed to the high-stage inlet port of methane compressor 71.

The liquid portion of the reduced-pressure stream exits high-stage methane flash drum 82 through conduit 142A to then re-enter methane economizer 73, wherein the liquid stream can be cooled through indirect heat exchange means 74 of methane economizer 73. The resulting cooled stream exits main methane economizer 73 through conduit 144 and can then be routed to a second expansion stage, illustrated here as intermediate-stage expansion valve 83 but could include an expander. Intermediate-stage expansion valve 83 further reduces the pressure of the cooled stream which reduces the stream's temperature by vaporizing or flashing a portion thereof. The stream in conduit 146 can then enter intermediate-stage methane flash drum 84, wherein the liquid and vapor portions of this stream can be separated and can exit the intermediate-stage flash drum 84 through respective conduits 148 and 150. The vapor portion (also called the intermediate-stage flash gas) in conduit 150 can re-enter methane economizer 73, wherein the vapor portion can be heated through an indirect heat exchange means 77 of main methane economizer 73. The resulting warmed stream can then be routed through conduit 154 to the intermediate-stage inlet port of methane compressor 71.

The liquid stream exiting intermediate-stage methane flash drum 84 through conduit 148 can then pass through a low-stage expansion valve 85 and/or expander, whereupon the pressure of the liquefied stream can be further reduced to thereby vaporize or flash a portion thereof. The resulting cooled, stream in conduit 156 can then enter low-stage methane flash drum 86, wherein the vapor and liquid phases can be separated. The liquid stream exiting low-stage methane flash drum 86 through conduit 158 can comprise the liquefied natural gas (LNG) product. The LNG product, which is at about atmospheric pressure, can be routed through conduit 158 downstream for subsequent storage, transportation, and/or use.

The vapor stream exiting low-stage methane flash drum (also called the low-stage methane flash gas) in conduit 160 can be routed to methane economizer 73, wherein the low-stage methane flash gas can be warmed through an indirect heat exchange means 78 of main methane economizer 73. The resulting stream can exit methane economizer 73 through conduit 164, whereafter the stream can be routed to the low-stage inlet port of methane compressor 71.

Methane compressor 71 can comprise one or more compression stages. In one embodiment, methane compressor 71 comprises three compression stages in a single module. In another embodiment, one or more of the compression modules can be separate, but can be mechanically coupled to a common driver. Generally, one or more intercoolers (not shown) can be provided between subsequent compression stages.

As shown in FIG. 1, a compressed methane refrigerant stream exiting methane compressor 71 can be discharged into conduit 166 and routed to methane cooler 72, whereafter the stream can be cooled through indirect heat exchange with an external fluid (e.g., air or water) in methane cooler 72. The resulting cooled methane refrigerant stream exits methane cooler 72 through conduit 111, whereafter a portion of the methane refrigerant can be routed through conduit 431 as a fuel gas balance line to supplement fuel gas flow in conduit 410, while the remaining portion of the methane refrigerant stream can be optionally directed to and further cooled in propane refrigeration cycle 30.

In particular, the methane refrigerant stream may be directed to the propane refrigeration cycle 30 along conduit 112 and cooled through heat exchanger means 37 of the high stage propane chiller 33B, heat exchanger means 48 of the intermediate-stage propane chiller 34, and heat exchanger means 49 of the low-stage propane chiller 35. Alternatively, all or a portion of the methane refrigerant stream may bypass the propane refrigeration cycle 30 through conduit 113. Irrespective of whether the methane refrigerant stream is routed through the propane refrigeration cycle 30 or not, the stream is subsequently routed to main methane economizer 73, wherein the stream can be further cooled through indirect heat exchange means 79. The resulting sub-cooled stream exits main methane economizer 73 through conduit 168.

The cooled methane recycle stream of conduit 168 is routed to the low-stage ethylene chiller/condenser 55. As shown, rather than combining the methane recycle stream with the natural gas stream before entering the methane economizer 73, the methane recycle stream is independently managed to retain the higher nitrogen concentration of the methane recycle stream flowing through conduit 168 and to maintain the higher pressure of the natural gas stream flowing through conduit 122. Independent conduits allow the natural gas stream and the methane recycle stream to be cooled and condensed separately.

In low-stage ethylene chiller/condenser 55, the methane recycle stream is cooled and at least partially condensed in a core 402 of the low-stage ethylene chiller/condenser 55. The methane recycle stream exits the low-stage ethylene chiller/condenser 55 through conduit 404 and is routed to the methane recycle separator drum 54 configured to separate the methane recycle stream into a vapor portion and a liquid portion. The vapor portion exits the methane recycle separator drum 54 through conduit 408 and is routed to an indirect heat exchange means 433 of the methane economizer 73. The vapor portion exiting the methane recycle separator drum 54 may be supplemented with methane recycle vapor from downstream of the methane cooler 72, as required to meet specifications for a fuel gas used to power portions of the LNG facility. The methane economizer 73 warms the vapor stream, which is then routed through conduit 410 and an outlet 432 and provided as the fuel gas referenced above.

The liquid portion generated in the methane recycle separator drum 54 exits the methane recycle separator drum 54 via conduit 412 and sub-cooled in the methane economizer 73 via indirect heat exchange means 434. The sub-cooled liquid portion exits the methane economizer through conduit 414 and is let down across the second high-stage methane expansion valve and/or expander 87, whereupon the pressure of this stream is reduced to thereby vaporize or flash a portion thereof. The resulting two-phase methane-rich stream in conduit 416 can then enter the second high-stage methane flash drum 88, whereupon the vapor and liquid portions of the reduced-pressure stream can be separated. The vapor portion of the reduced-pressure stream exits the second high-stage methane flash drum 88 through conduit 418 to then enter methane economizer 73, wherein at least a portion of the high-stage flash gas can be heated through indirect heat exchange means 420 of methane economizer 73. The resulting warmed vapor stream exits main methane economizer 73 through conduit 422. A portion of the stream flowing through conduit 422 may be directed to a nitrogen rejection unit. The balance of the warmed stream enters the high-stage inlet port of methane compressor 71 via conduit 430.

The liquid portion of the reduced-pressure stream exits the second high-stage methane flash drum 88 through conduit 142B and is combined with the liquid portion of the natural gas stream exiting the first high-stage methane flash drum 82. Together, the liquid portions pass through conduit 142 for further processing within an intermediate stage and a low stage of the expansion section 80, as discussed in detail above.

The above-described embodiments provide increased refrigeration efficiency of the overall system and process. Specifically, efficiency improvements ranging from about 0.85% to about 1.44% have been observed. In particular, the novel embodiments increase the nitrogen concentration in the feed stream to the nitrogen rejection unit (NRU) and in the fuel gas supply, which results in a reduction in the feed rate to the NRU ranging from about 10% to 15%. The reduction in the feed rate combined with the increased nitrogen concentration in the feed stream to the NRU advantageously reduces the size and cost of the NRU.

Additionally, as the feed to the NRU comes from the flash of the methane recycle stream as opposed to the flash of the combined feed gas and methane recycle stream in prior processes, the impact of fluctuations in feed gas flow and composition on the NRU operation is lessened, resulting in improved controllability and operability of the NRU.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A process of liquefying a natural gas stream in a liquefied natural gas (LNG) facility, the process comprising:

cooling the natural gas stream in a first refrigeration cycle to produce a cooled natural gas stream;

cooling the cooled natural gas stream in a first chiller of a second refrigeration cycle, the cooled natural gas stream exiting the first chiller at a first pressure;

cooling the cooled natural gas stream in a first core of a second chiller of the second refrigeration cycle; and cooling a refrigerant of a refrigerant recycle stream separate from the cooled natural gas stream in a second core of the second chiller of the second refrigeration cycle, wherein the refrigerant recycle stream enters the second chiller at a second pressure that is lower than the first pressure of the cooled natural gas stream; routing the cooled natural gas stream from the second refrigerant cycle to a heat exchanger for cooling therein; reducing the pressure of the cooled natural gas stream in a first expansion component disposed downstream of the heat exchanger; routing the cooled natural gas stream to a first flash drum configured to separate the cooled natural gas stream into a natural gas vapor portion and a natural gas liquid portion; routing the natural gas vapor portion to the heat exchanger for heating therein; routing the natural gas vapor portion from the heat exchanger to an inlet port of a compressor; routing the refrigerant recycle stream from the second chiller of the second refrigeration cycle to a methane recycle flash drum configured to separate the refrigerant recycle stream into a refrigerant vapor portion and a refrigerant liquid portion; routing the refrigerant liquid portion to the heat exchanger for cooling therein; reducing the pressure of the refrigerant liquid portion in a second expansion component disposed downstream of the heat exchanger; and routing the refrigerant liquid portion to a second flash drum configured to separate the refrigerant liquid portion into a refrigeration recycle vapor portion and a refrigeration recycle liquid portion.

2. The process of claim 1, further comprising:

compressing the refrigerant in the compressor;

cooling the refrigerant downstream of the compressor;

cooling the refrigerant in the heat exchanger; and routing the refrigerant out of the heat exchanger to produce the refrigerant recycle stream that is configured to be cooled downstream of the heat exchanger in the second core of the second chiller of the second refrigeration cycle.

3. The process of claim 2, wherein cooling the refrigerant downstream of the compressor comprises cooling the refrigerant in a refrigerant cooler.

4. The process of claim 3, wherein cooling the refrigerant downstream of the compressor further comprises cooling the refrigerant in the first refrigeration cycle.

5. The process of claim 2, wherein the refrigerant comprises a methane-rich stream.

6. The process of claim 1, further comprising routing the refrigerant vapor portion to the heat exchanger for heating therein and providing the refrigerant vapor portion to a fuel gas supply.

7. The process of claim 1, further comprising routing the refrigerant recycle vapor portion to a nitrogen rejection unit.

8. The process of claim 7, wherein the refrigerant recycle vapor portion is heated in the heat exchanger prior to being routed to the nitrogen rejection unit.

9. The process of claim 7, further comprising routing a portion of the refrigerant recycle vapor portion to an inlet port of a compressor.

10. The process of claim 1, further comprising mixing the refrigerant recycle liquid portion with the natural gas liquid portion exiting the first flash drum.

* * * * *